US012202642B2

(12) United States Patent
Wang et al.

(10) Patent No.: US 12,202,642 B2
(45) Date of Patent: Jan. 21, 2025

(54) ANTI-OPENING CONTAINER

(71) Applicant: SOUTH PLASTIC INDUSTRY CO., LTD., New Taipei (TW)

(72) Inventors: Tong-Chang Wang, New Taipei (TW); Pei-Yu Wang, New Taipei (TW)

(73) Assignee: SOUTH PLASTIC INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 18/172,805

(22) Filed: Feb. 22, 2023

(65) Prior Publication Data

US 2024/0239552 A1 Jul. 18, 2024

(30) Foreign Application Priority Data

Jan. 18, 2023 (TW) ..... 112102468

(51) Int. Cl.

| | |
|---|---|
| ***B65D 6/24*** | (2006.01) |
| ***B65D 17/00*** | (2006.01) |
| ***B65D 17/32*** | (2006.01) |
| ***B65D 55/02*** | (2006.01) |

(52) U.S. Cl.

CPC ..... *B65D 11/188* (2013.01); *B65D 17/04* (2013.01); *B65D 17/32* (2018.01); *B65D 55/024* (2013.01); *B65D 2401/00* (2020.05); *B65D 2517/0008* (2013.01)

(58) Field of Classification Search

CPC ..... B65D 11/188; B65D 17/04; B65D 17/32; B65D 55/024; B65D 2517/0008; B65D 2401/00

See application file for complete search history.

(56) References Cited

U.S. PATENT DOCUMENTS

| | | | | |
|---|---|---|---|---|
| 4,986,438 | A * | 1/1991 | Borst | B65D 45/20 229/406 |
| 6,666,348 | B2 * | 12/2003 | Fore | B65D 45/20 220/676 |
| 2009/0206082 | A1 * | 8/2009 | Vovan | B65D 43/0249 29/428 |
| 2012/0103990 | A1 * | 5/2012 | McCumber | B65D 41/165 220/270 |
| 2017/0283139 | A1 * | 10/2017 | Fosse | B65D 75/22 |
| 2018/0079568 | A1 * | 3/2018 | Shmeltzer | B65D 43/0239 |

* cited by examiner

*Primary Examiner* — James N Smalley

(74) *Attorney, Agent, or Firm* — RABIN & BERDO, P.C.

(57) ABSTRACT

An anti-opening container includes a first box and a second box. The first box includes a first body, a first box section and a first gripping section. The first box section is formed by the extension of the first body. The second box includes a second body, a second box section, a second gripping section, an extension section, and a fastener section. The second box section is formed by the extension of the second body. The fastener section is connected to the extension section via a perforated line. The fastener section is embedded in the first box section. When the first gripping section and the second gripping section are displaced in opposite directions, the perforated line breaks, and the first box section and the fastener section are separated from the second box section together to separate the first box and the second box.

7 Claims, 17 Drawing Sheets

ANTI-OPENING CONTAINER

CROSS-REFERENCE TO RELATED APPLICATION

This non-provisional application claims priority under 35 U.S.C. § 119(a) to patent application Ser. No. 11/210,2468 filed in Taiwan, R.O.C. on Jan. 18, 2023, the entire contents of which are hereby incorporated by reference.

BACKGROUND

Technical Field

The disclosure relates to a container, in particular to a container that is capable of preventing a lid from falling off, can be identified as being opened or not, and cannot be restored once being opened.

Related Art

Currently, most of packaging containers used in supermarkets, food sales departments and restaurants are made of plastic or paper. However, some consumers may open outer containers privately when browsing the commodities, which will cause the contents to deteriorate. Moreover, if the outer container is opened but its opening is not found, improper additives may be added to the food. Therefore, some businesses will put tape or stickers on the packaging containers for the consumers to identify the opening of the outer containers, so as to prevent the consumers from buying the commodities whose outer containers have been opened. However, the tape or stickers may be put back after the outer containers are opened.

Besides, it often happens that the lid is separated from the box when the outer container is hit by an external force during transportation of food. In all the cases above, the freshness and safety of the commodities cannot be ensured in deed.

SUMMARY

The disclosure provides an anti-opening container, mainly consisting of a first box and a second box. The first box includes a first body, a first box section and a first gripping section. The first body mainly includes a first base and a first side wall. The first side wall forms a receiving space around the first base, and the first base is substantially parallel to a horizontal plane. The first box section is formed by the extension of the first side wall and includes a first fastening groove. A depression direction of the first fastening groove is substantially perpendicular to the horizontal plane. The first gripping section is formed by the extension of the first side wall. The second box mainly includes a second body, a second box section, a second gripping section, an extension section, and a fastener section. The second body includes a second base and a second side wall. The first base and the second base are arranged opposite to each other, and the second side wall forms an accommodating space around the second base. The second box section is formed by the extension of the second side wall and includes a second fastening groove. A depression direction of the second fastening groove is substantially perpendicular to the horizontal plane. The second gripping section is formed by the extension of the second side wall. The extension section is formed by the extension of the second box section. The fastener section is formed by the extension of the extension section and connected to the extension section via a perforated line.

When the first box is combined with the second box, the first box section is stacked on the second box section, and the fastener section is embedded in the first box section. When the first gripping section and the second gripping section are displaced in opposite directions, the perforated line breaks, and the first box section and the fastener section are separated from the second box section together to separate the first box and the second box.

Based on the above, the anti-opening container of the disclosure can be opened only after a user pinches the first gripping section and the second gripping section and displace them in opposite directions. While the anti-opening container is opened, the perforated line breaks, and the extension section spreads out in the direction away from the first box, and the fastener section and the first box section that are in close fit with each other are separated from the second box section together. Therefore, the user can easily determine whether the anti-opening container has been opened from appearance, which can prevent the user from buying and eating food whose anti-opening container has been opened, and can reduce the consumption disputes. Besides, the fastener section is embedded in the first box section, which can prevent the anti-opening container from being easily opened due to the hit during transportation.

The detailed features and advantages of the disclosure are set forth in the detailed description of the embodiments of the disclosure, the content of which is sufficient for any person skilled in the art to understand the technical content of the disclosure and implement it based thereon. According to the contents, scope and drawings disclosed in this specification, any person skilled in the art can easily understand the objects and advantages associated with the disclosure.

DETAILED DESCRIPTION

Figure 1:
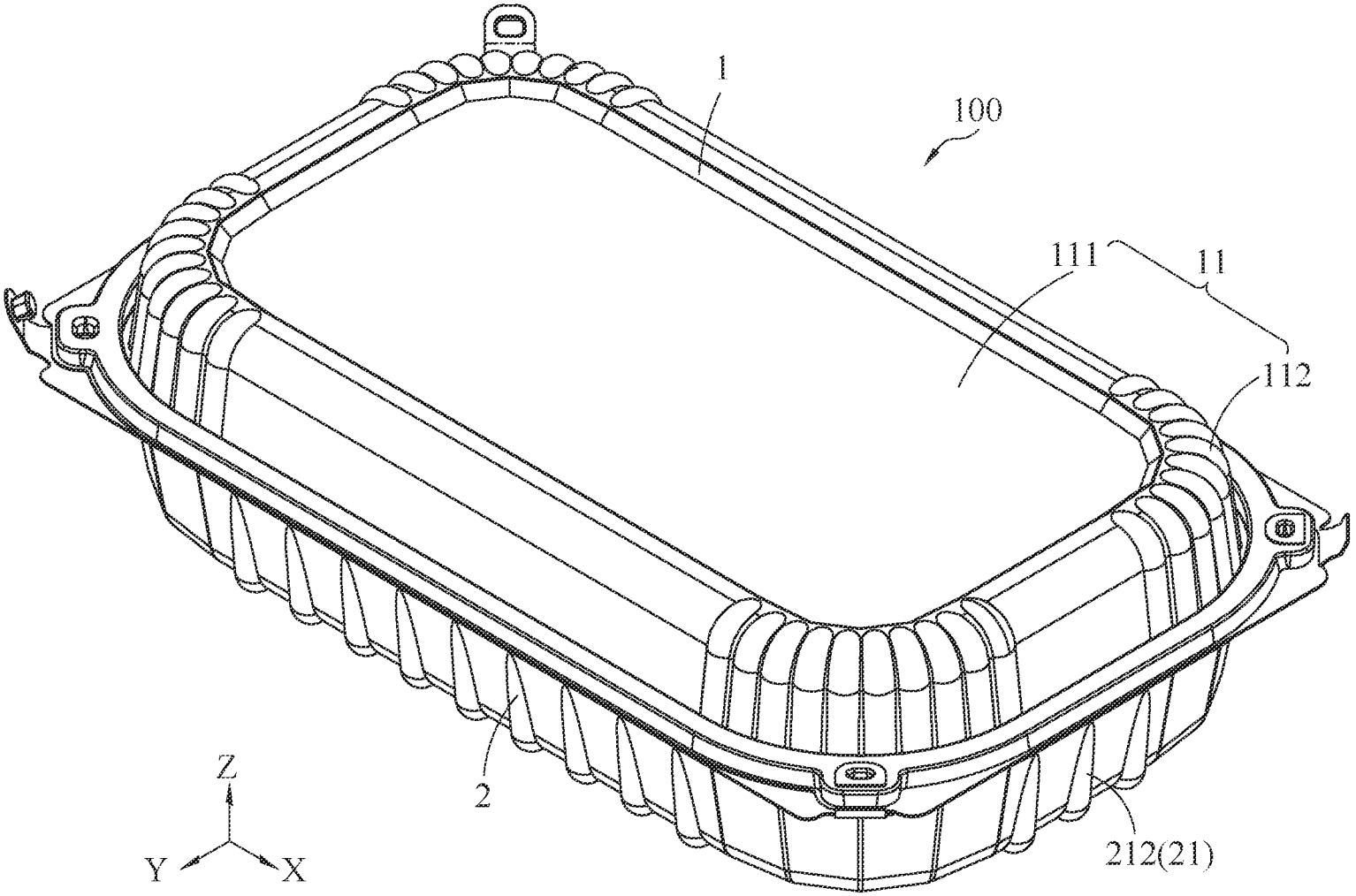
FIG. 1 is a three-dimensional outside view of a first embodiment of the disclosure in a closed state.

Various embodiments are provided below for detailed description. However, the embodiments are only used as embodiments and will not limit the scope of protection of the disclosure. Well-known elements and steps are not described in the embodiments to avoid unnecessary limitation to the contents of the disclosure. In addition, some elements are omitted from the drawings in the embodiments to clearly show the technical characteristics of the disclosure. The same reference numerals in all drawings will be used to indicate the same or similar elements.

Unless specially defined, the terms "a" and "the" used herein may refer to one or more in general. It will be further understood that the terms "include", "have" and similar words used herein indicate the features, regions, integers, steps, operations, elements and/or components described therein, but do not exclude one or more other features, regions, integers, steps, operations, elements, components and/or groups thereof as described therein or in addition thereto.

First Embodiment

Figure 2:
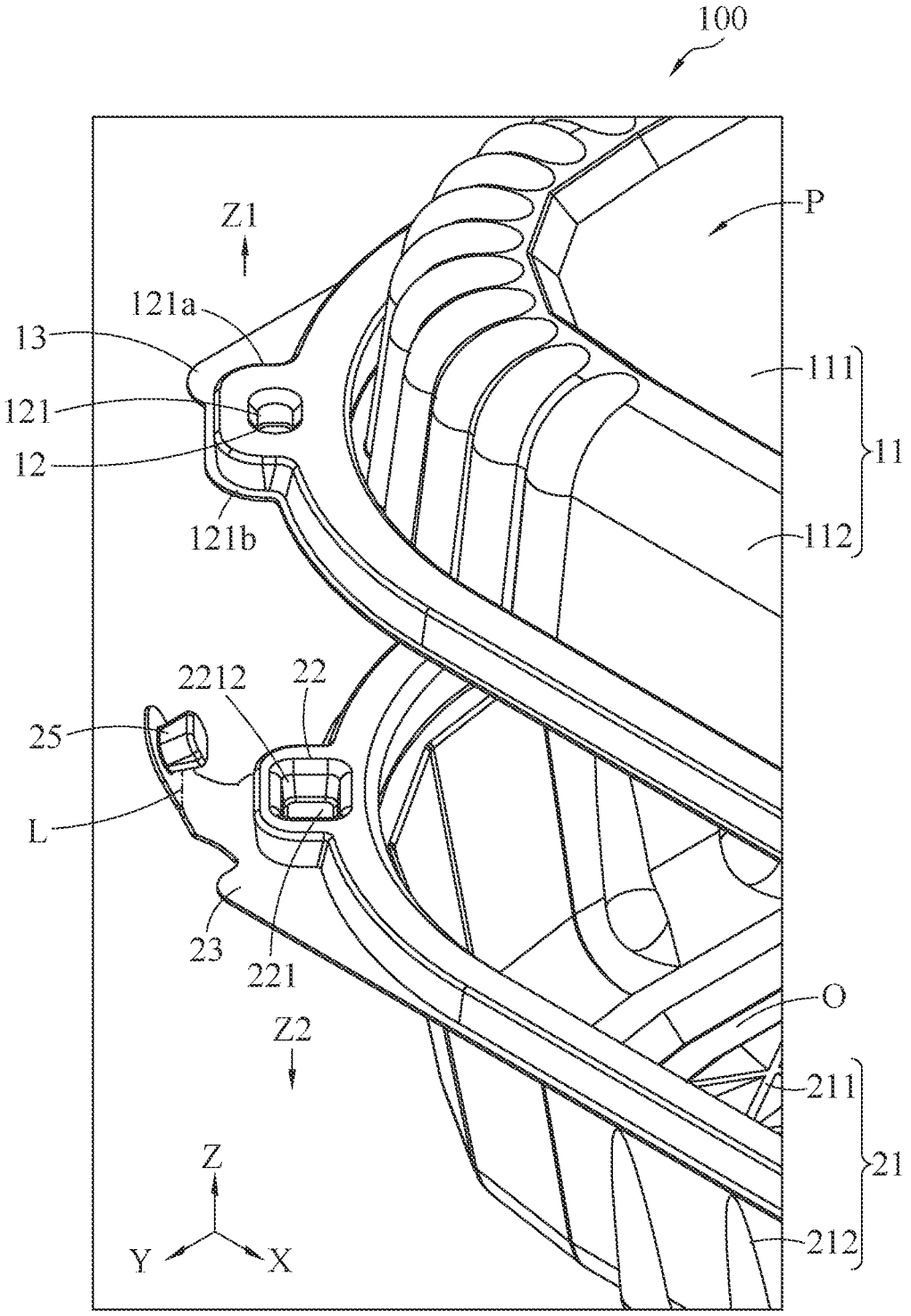
FIG. 2 is a partial enlarged view of the first embodiment of the disclosure in a to-be-closed state.
Figure 3:
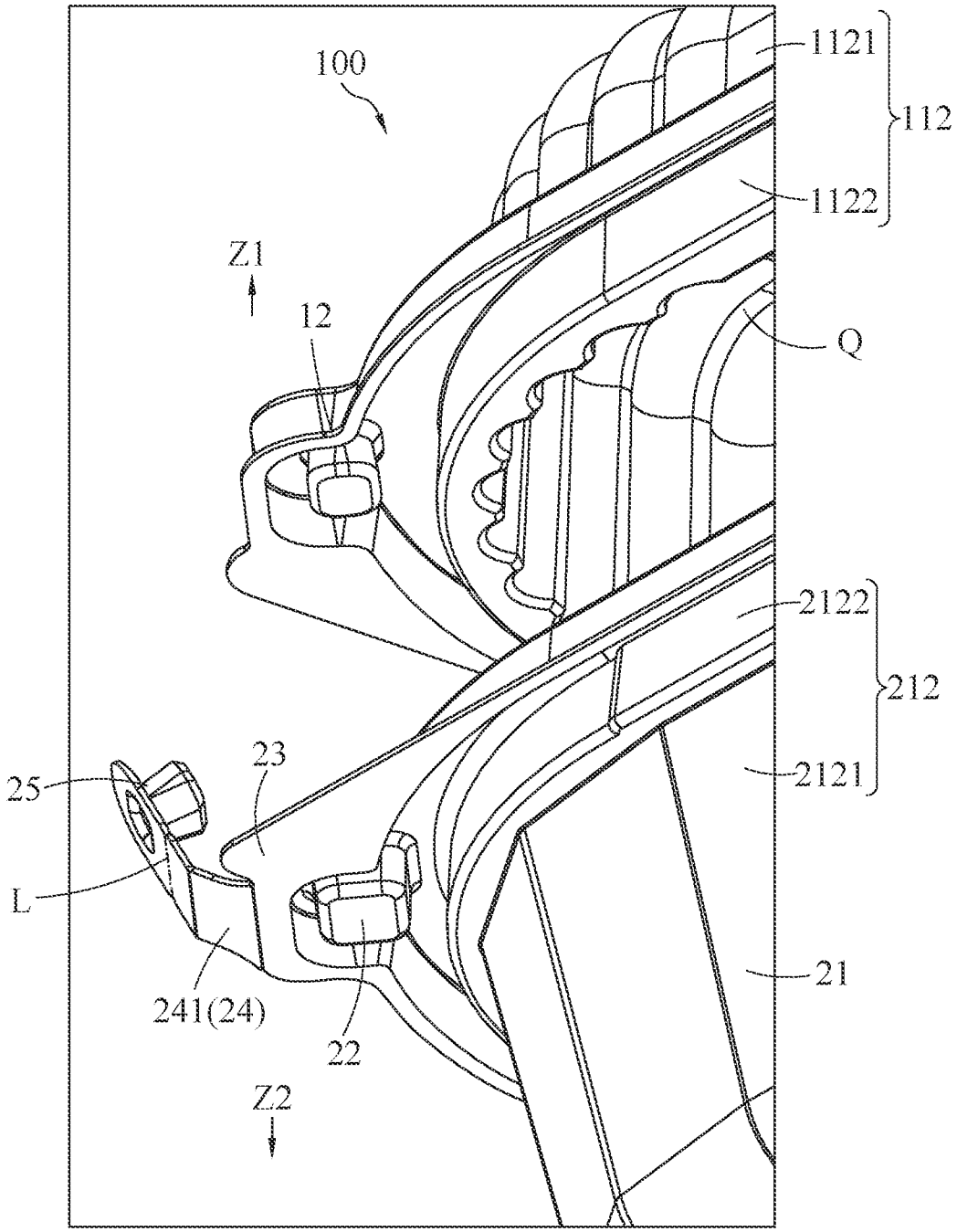
FIG. 3 is a partial enlarged view of the first embodiment of the disclosure in a to-be-closed state from another viewing angle.

Referring to FIG. 1 to FIG. 3, an anti-opening container 100 of the disclosure mainly includes a first box 1 and a second box 2. The first box 1 and the second box 2 have an accommodating space. Although the first box 1 and the second box 2 are represented as hollow cuboids in the drawings, the disclosure does not limit the shapes of the first box 1 and the second box 2, which may also be hollow round boxes, hollow elliptical boxes or other polygonal shapes and can be designed according to actual needs.

In some embodiments, as shown in FIG. 1, the first box 1 (*lid*) is used to cover the second box 2 (*box*), but the disclosure is not limited thereto. For example, the second box 2 may also be used to cover the first box 1.

Referring to FIG. 1 to FIG. 5, the first box 1 may mainly consist of a first body 11, a first box section 12 and a first gripping section 13.

The first body 11 may mainly consist of a first base 111 and a first side wall 112. The first side wall 112 forms a receiving space Q around the first base 111, and the first base 111 is substantially parallel to a horizontal plane P.

Referring to FIG. 2 and FIG. 3, the first box section 12 is formed by extending from an end corner of the first side wall 112, but the disclosure is not limited thereto. The first box section 12 may also be formed by extending from a side edge of the first side wall 112. The first box section 12 includes a first fastening groove 121. A depression direction Z2 of the first fastening groove 121 is substantially perpendicular to the horizontal plane P. That is, the depression direction Z2 of the first fastening groove 121 is substantially perpendicular to the first base 111. As shown in FIG. 1, the first box section 12 is arranged at four end corners of the first box 1, but the disclosure is not limited thereto. The first box section 12 may also be arranged at a side edge of the first box 1, and the disclosure does not limit the quantity of the first box sections 12 arranged.

The first gripping section 13 is formed by the extension of the first side wall 112. As shown in FIG. 2, the first gripping section 13 may extend from an end corner of the first side wall 112 and be parallel to the first base 111 of the first body 11, but the disclosure is not limited thereto. The first gripping section 13 may be arranged according to actual needs. For example, the first gripping section 13 may also not be parallel to the first base 111.

Referring to FIG. 2 and FIG. 3, the second box 2 may mainly consist of a second body 21, a second box section 22, a second gripping section 23, an extension section 24 and a fastener section 25.

The second body 21 may mainly consist of a second base 211 and a second side wall 212. The second side wall 212 forms an accommodating space O around the second base 211. The first base 111 and the second base 211 are arranged opposite to each other. That is, the first base 111 is substantially parallel to the second base 211.

The second box section 22 is formed by extending from an end corner of the second side wall 212, but the disclosure is not limited thereto. The second box section 22 may also be formed by extending from a side edge of the second side wall 212. The second box section 22 includes a second fastening groove 221. A depression direction Z2 of the second fastening groove 221 is substantially perpendicular to the horizontal plane P. That is, the depression direction Z2 of the second fastening groove 221 is substantially perpendicular to the second base 211. As shown in FIG. 1, the second box section 22 is arranged at four corners of the second box 2, but the disclosure is not limited thereto. The second box section 22 may also be arranged at a side edge of the second box 2, and the disclosure does not limit the quantity of the second box sections 22 arranged.

The second gripping section 23 is formed by the extension of the second side wall 212. As shown in FIG. 2, the second gripping section 23 may extend from an end corner of the second side wall 212 and be parallel to the second base 211, but the disclosure is not limited thereto. The second gripping section 23 may be arranged according to actual needs. For example, the second gripping section 23 may also not be parallel to the second base 211.

Figure 5:
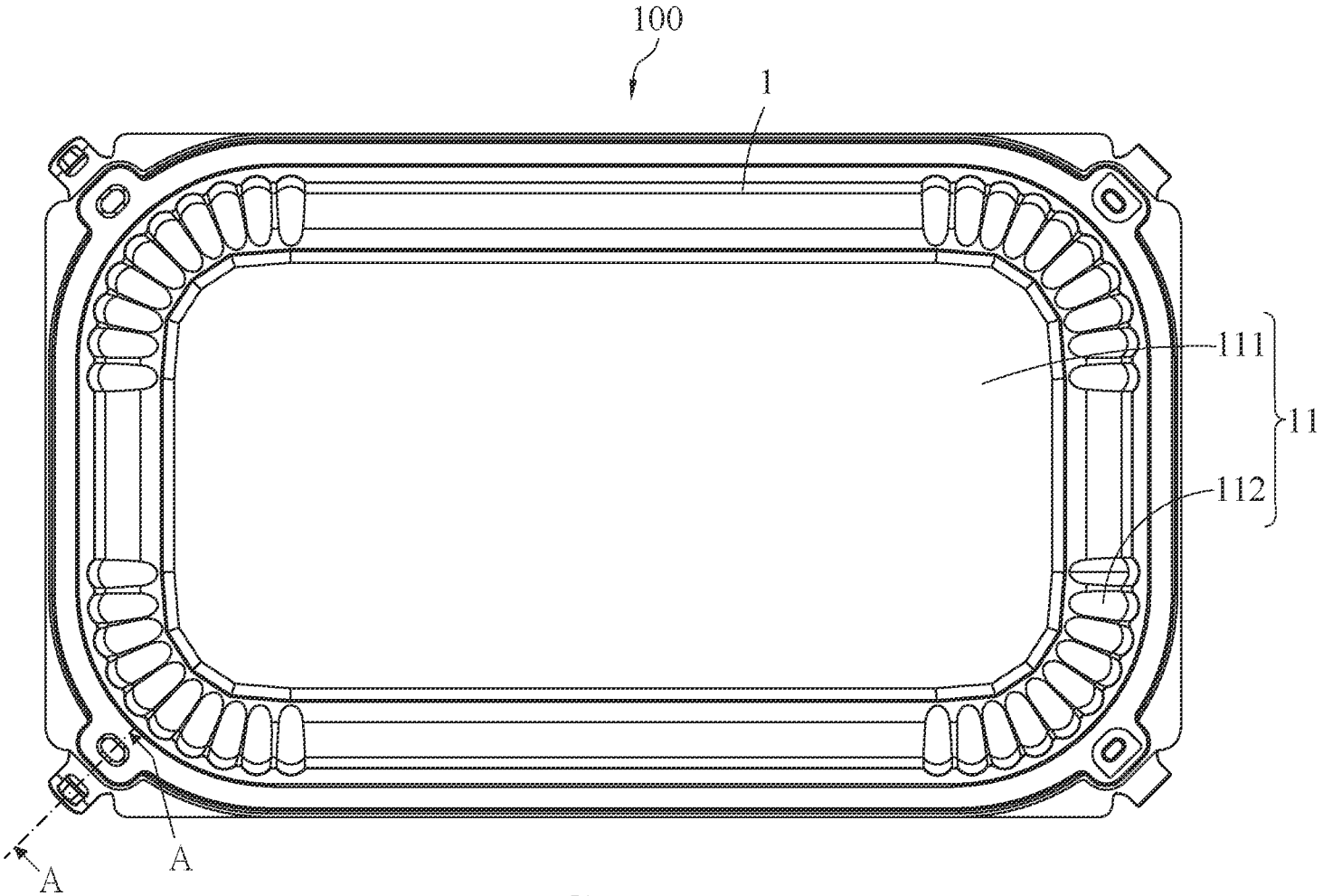
FIG. 5 is a top view of the first embodiment of the disclosure in a closed state.
Figure 6:
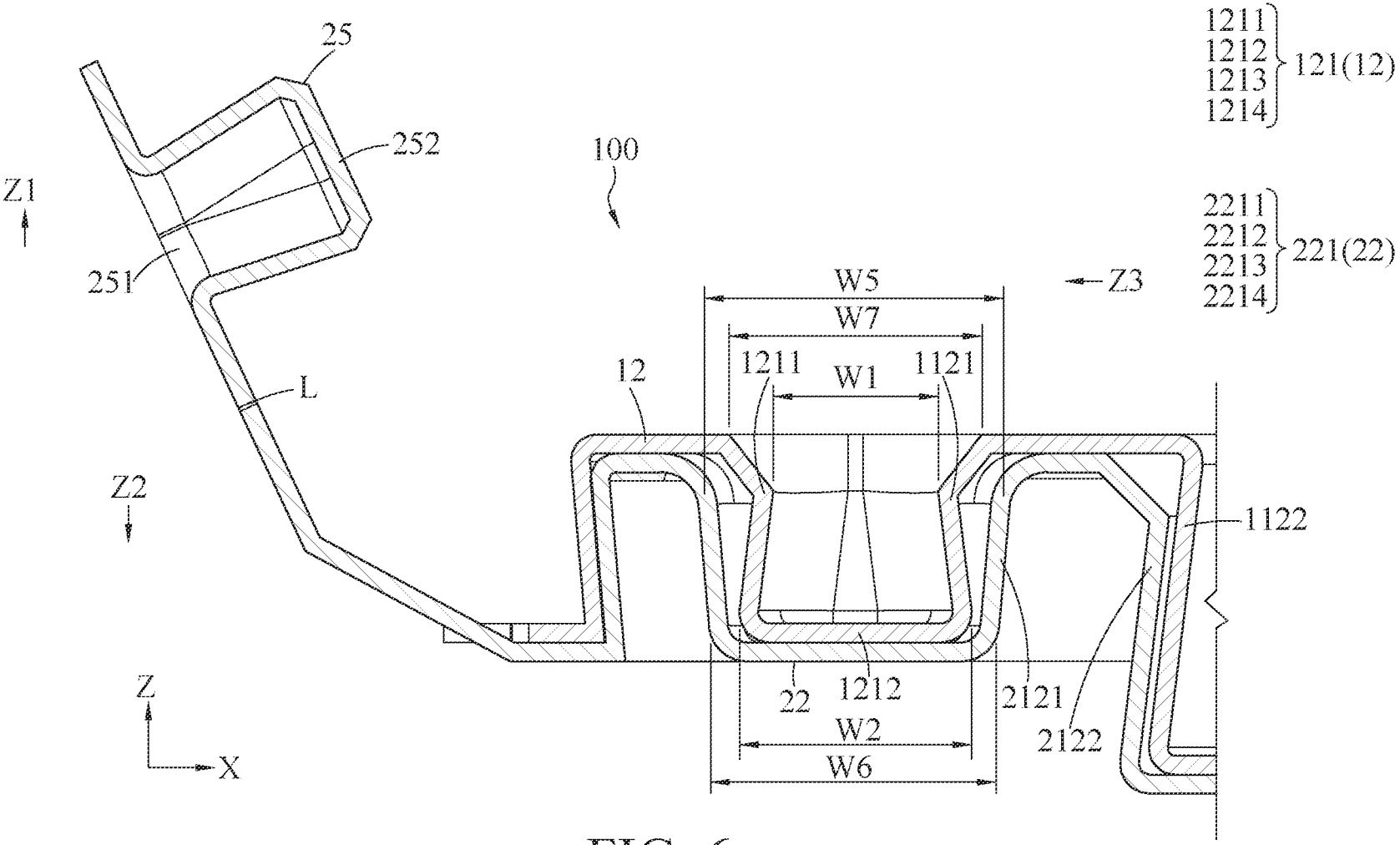
FIG. 6 is a sectional view taken along a line A-A in FIG. 5.
Figure 12:
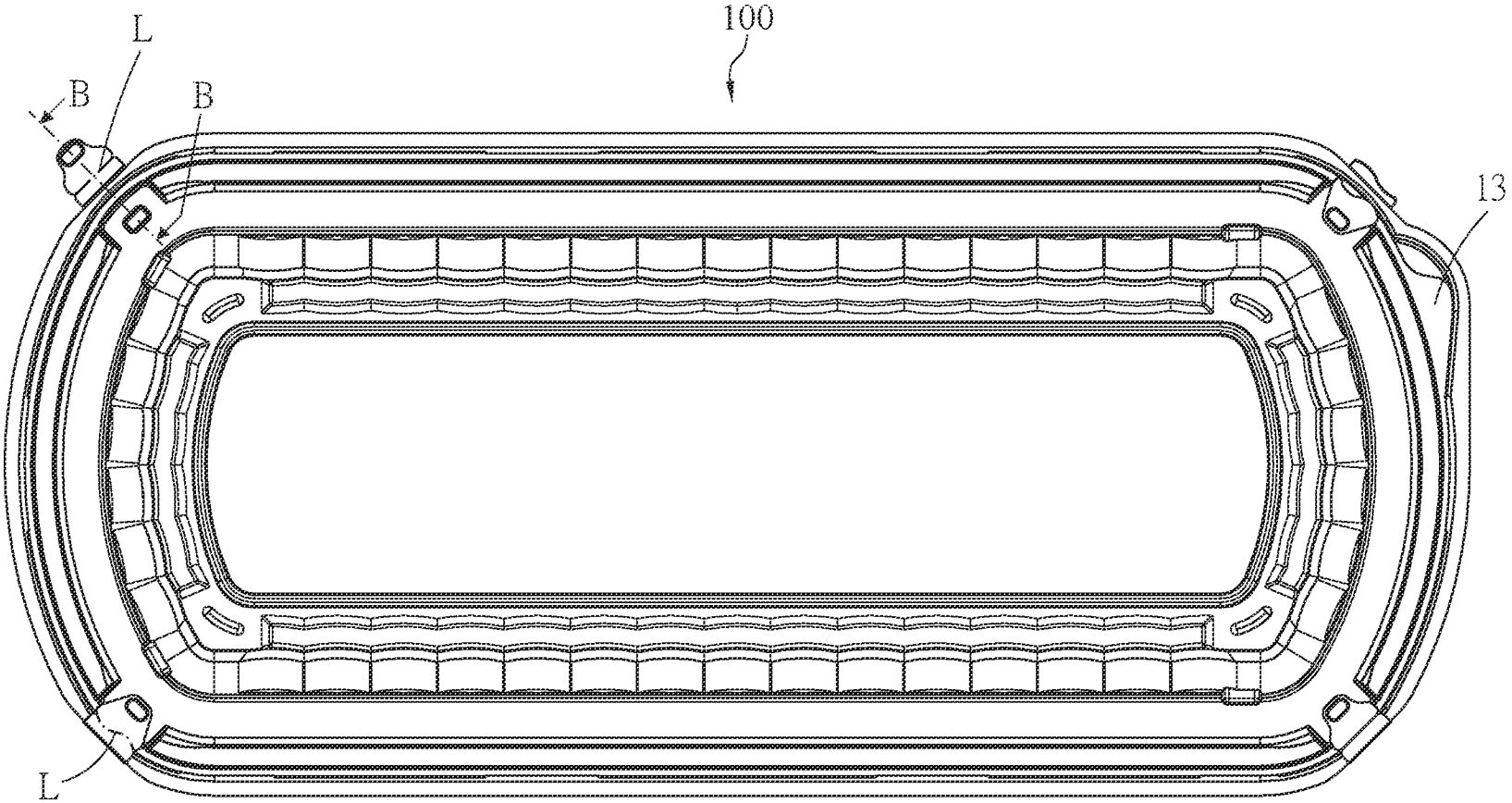
FIG. 12 is a top view of the second embodiment of the disclosure in a closed state.

As shown in FIG. 3 and FIG. 6, FIG. 6 is a sectional view of FIG. 5 taken along line A-A. The extension section 24 is formed by the extension of the second box section 22, and the fastener section 25 is formed by the extension of the extension section 24 and connected to the extension section 24 via a perforated line L. In other words, the fastener section 25 is located at an end of the extension section 24 away from the second body 21. The second box section 22, the extension section 24 and the fastener section 25 may be integrally formed, and the perforated line L is formed by die pressing, so that the fastener section 25 can be torn along the perforated line L and separated from the extension section 24. Here, the perforated line L may be a straight line (as shown in FIG. 3), but the disclosure is not limited thereto. The shape of the perforated line L can be designed according to actual needs. For example, the perforated line L may be in an S shape (as shown in FIG. 12). Besides, the disclosure does not limit the perforated line L of one anti-opening container 100 to be in only one form. For example, the anti-opening container 100 shown in FIG. 12 includes a straight perforated line L and an S-shaped perforated line L.

Figure 7:
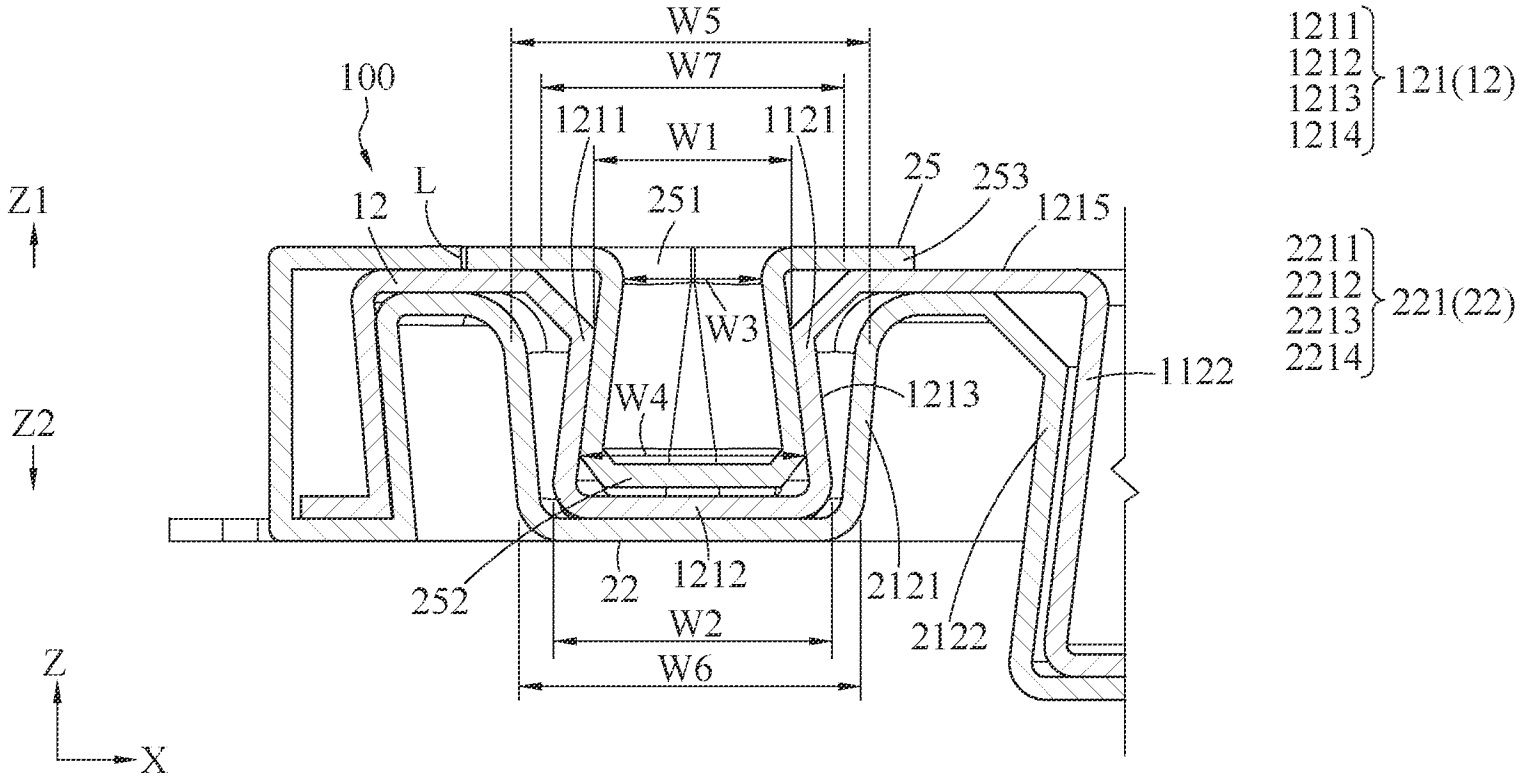
FIG. 7 is a partial sectional view of the first embodiment of the disclosure in a closed state.
Figure 8:
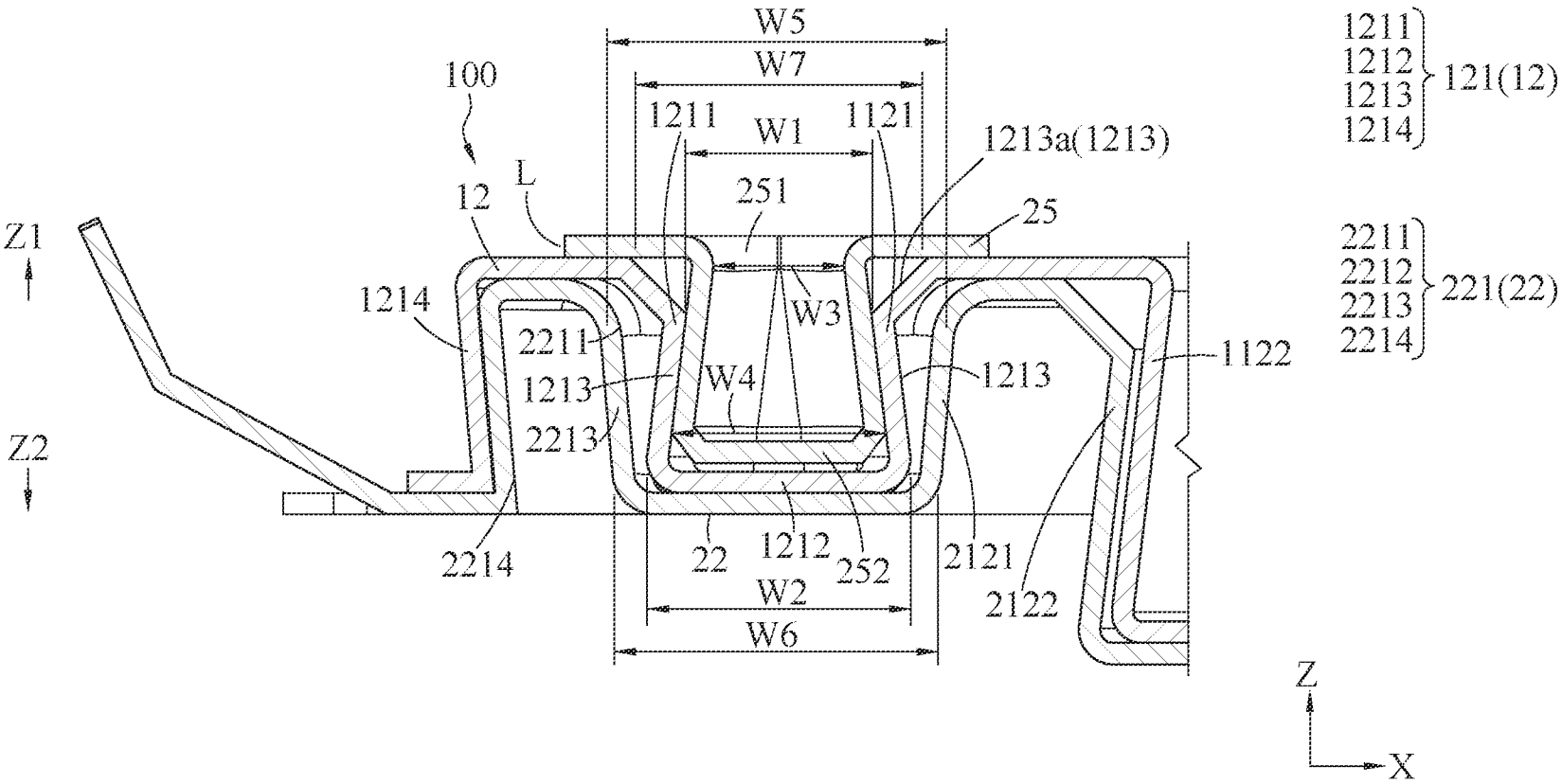
FIG. 8 is a partial sectional view of the first embodiment of the disclosure in a closed state and with the perforated line breaking.

Referring to FIG. 6 to FIG. 8, when the first box 1 is combined with the second box 2, the first box section 12 is stacked on the second box section 22 (as shown in FIG. 6). The fastener section 25 is embedded in the first box section 12 (as shown in FIG. 7), so that the first box 1 can be prevented from being separated from the second box 2 when the anti-opening container 100 is hit by an external force during transportation, which can prevent the anti-opening container 100 from being opened due to the hit during transportation. Here, the first box section 12 is only stacked on the second box section 22. In other words, the first box section 12 is not closely combined with the second box section 22. The fastener section 25 is closely combined with the first box section 12. That is, the fastener section 25 and the first box section 12 are in close fit with each other. Therefore, the first box section 12 can be easily separated from the second box section 22, and the fastener section 25 cannot be easily separated from the first box section 12.

Figure 4:
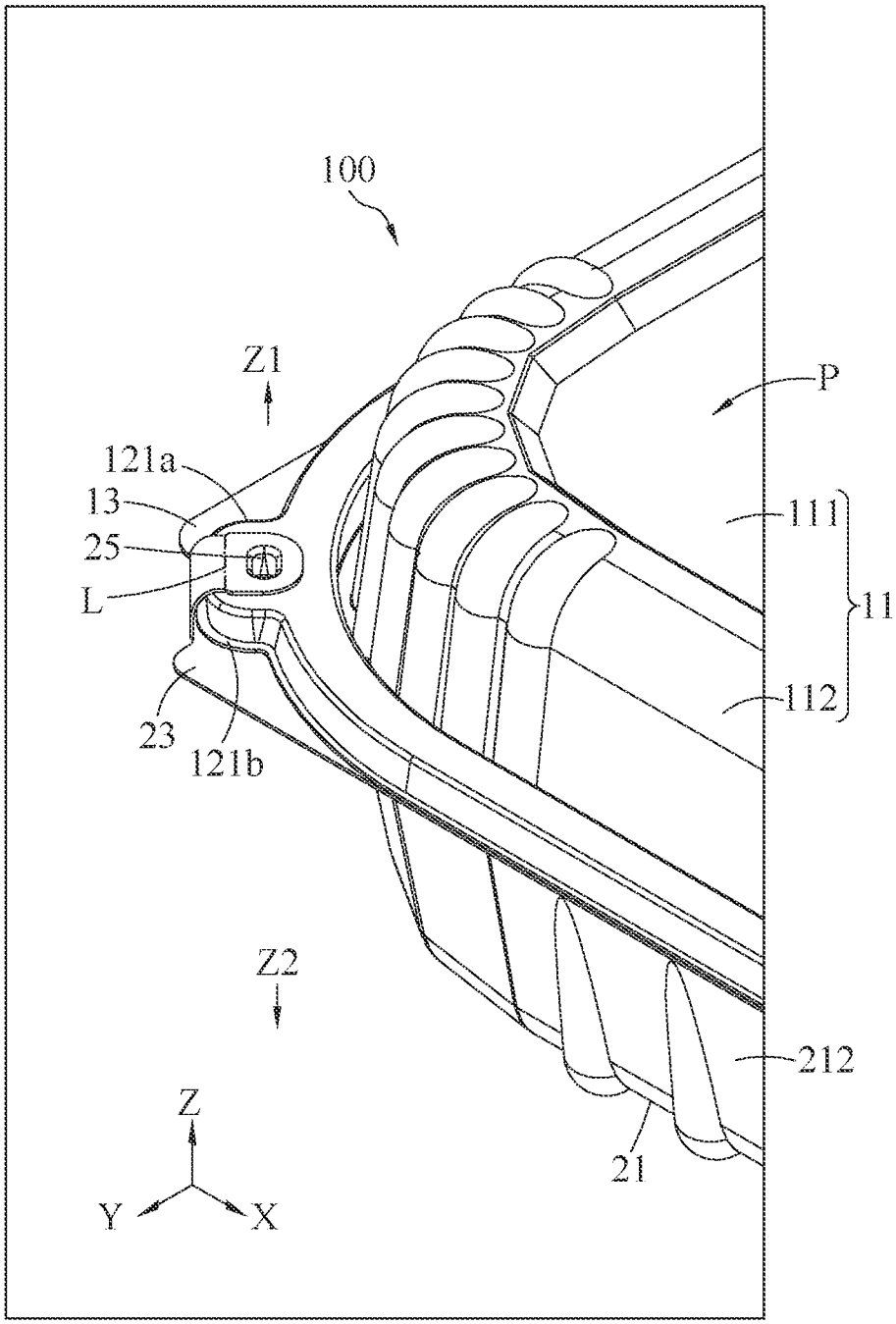
FIG. 4 is a partial enlarged view of the first embodiment of the disclosure in a closed state.
Figure 9:
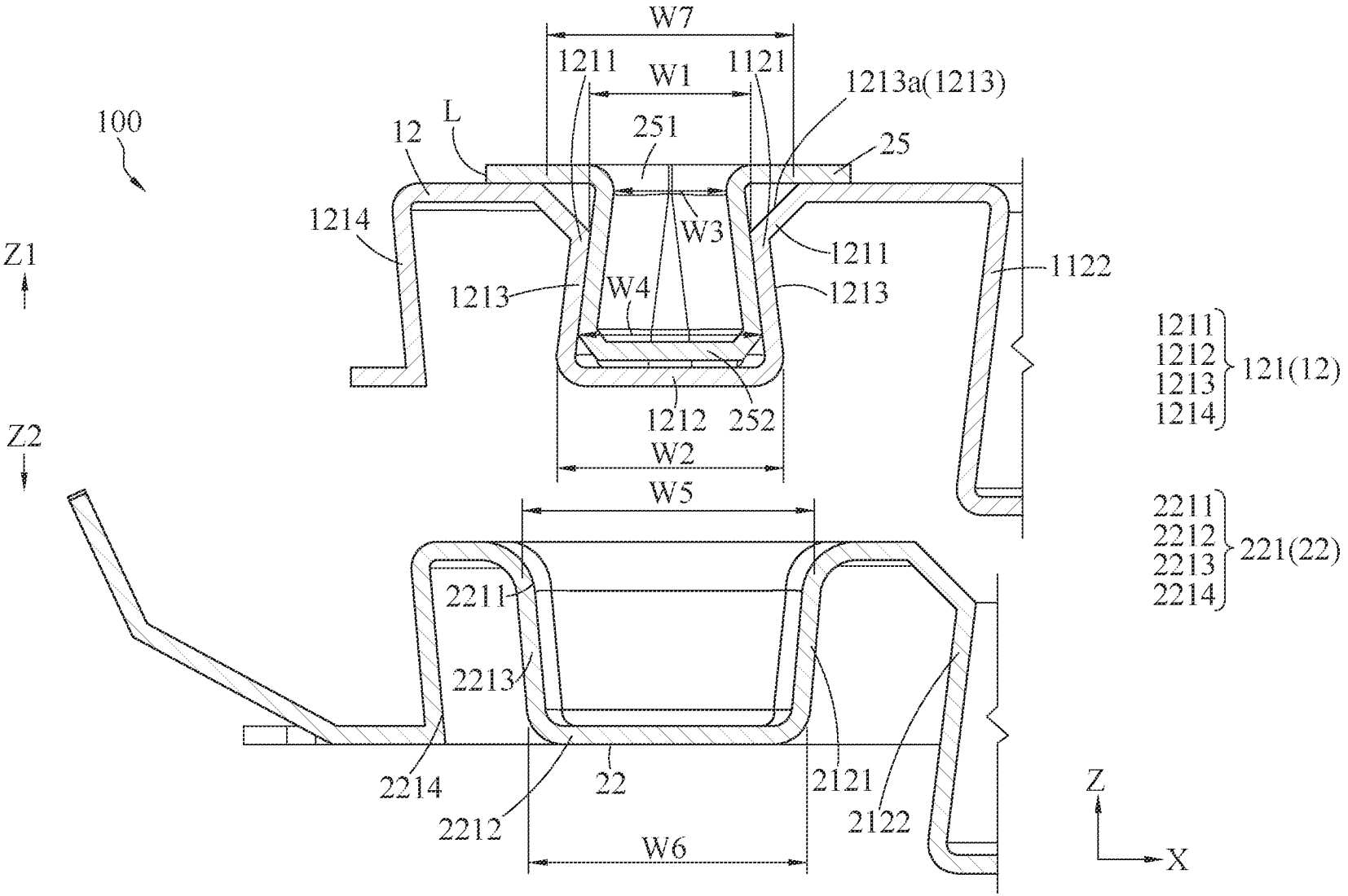
FIG. 9 is a partial sectional view of the first embodiment of the disclosure in an opened state.

Referring to FIG. 4, when the user pinches the first gripping section 13 and the second gripping section 23 and displaces the first gripping section 13 and the second gripping section 23 in opposite directions (for example, the first gripping section 13 is displaced toward the direction Z1 above the horizontal plane P, and the second gripping section 23 is displaced toward the direction Z2 below the horizontal plane P), the perforated line L is torn such that the perforated line L breaks (as shown in FIG. 8), and the fastener section 25 and the first box section 12 that are in close fit with each other can be separated from the second box section 22 together (as shown in FIG. 9). At this time, the first box 1 is separated from the second box 2 such that the anti-opening container 100 is opened.

Besides, since the perforated line L breaks, the extension section 24 is no longer connected to the fastener section 25 via the perforated line L, and the extension section 24 spreads out in the direction away from the first body 11 (as shown in FIG. 8 and FIG. 9), so that a user can know at first sight that the anti-opening container 100 has been opened.

Referring to FIG. 3, in some embodiments, the extension section 24 further includes a bending member 241 connected to the second gripping section 23 (i.e., the bending member 241 is arranged at one side of the second gripping section 23) and connected to the fastener section 25 via the perforated line L. When the first box 1 is combined with the second box 2, the bending member 241 bends such that the fastener section 25 is embedded in the second box section 22.

Referring to FIG. 2 and FIG. 3, in some embodiments, the first fastening groove 121 includes a first side 121*a* and a second side 121*b* opposite to each other. As shown in FIG. 4, the first box 1 is combined with the second box 2, the first gripping section 13 is located at the first side 121*a*, and the second gripping section 23 is located at the second side 121*b*. Thus, the user can conveniently pinch the first gripping section 13 and the second gripping section 23 respectively with two hands to displace the first gripping section 13 and the second gripping section 23 in opposite directions.

Referring to FIG. 3, in some embodiments, the first side wall 112 mainly includes a first side wall body 1121 and a first locking surface 1122. The first locking surface 1122 is located at an outer side of a periphery of the first side wall body 1121, and the first side wall body 1121 and the first locking surface 1122 may be integrally formed. The second side wall 212 mainly includes a second side wall body 2121 and a second locking surface 2122. The second locking surface 2122 is located at an outer side of a periphery of the second side wall body 2121, and the second side wall body 2121 and the second locking surface 2122 may be integrally formed.

As shown in FIG. 6, when the first box 1 is combined with the second box 2, the first locking surface 1122 is locked with the second locking surface 2122 so as to locate the first box 1 and the second box 2. Here, the first locking surface 1122 may abut against the second locking surface 2122 in a direction away from the center of the first box 1 such that the first locking surface 1122 is locked with the second locking surface 2122.

Referring to FIG. 7, the first fastening groove 121 may include a first neck 1211 and a first closing section 1212. The first closing section 1212 is a closed side of the first fastening groove 121. A first inner side wall 1213 of the first fastening groove 121 surrounds the first closing section 1212 and is generally of a hollow cylinder. A cross section of the first fastening groove 121 in the depression direction Z2 is generally flared from the first neck 1211 to the first closing section 1212, and is also flared from the first neck 1211 to the open side of the first fastening groove 121. In other words, the cross section of the first fastening groove 121 in the depression direction Z2 is generally in a shape of an hourglass.

The fastener section 25 may include a fastener opening section 251 and a fastener closing section 252. Here, the fastener section 25 may be a hollow cylinder, and its cross section in the depression direction Z2 is generally flared from the fastener opening section 251 to the fastener closing section 252.

A width W1 of the first neck 1211 of the first fastening groove 121 is less than a width W2 of the first closing section 1212, and a width W3 of the fastener opening section 251 of the fastener section 25 is less than a width W4 of the fastener closing section 252. Therefore, when the fastener section 25 is embedded in the first fastening groove 121, the closer the fastener section 25 is to the direction of the fastener closing section 252, the closer it abuts against the first fastening groove 121, so that the fastener section 25 cannot be separated from the first fastening groove 121 easily. As a result, when the first box 1 or a part of the first box 1 leaves the second box 2, the fastener section 25 remains combined with the first fastening groove 121.

In some embodiments, the width W4 of the fastener closing section 252 is slightly greater than the width W1 of the first neck 1211. Since the width W4 of the fastener closing section 252 of the fastener section 25 is greater than the width W1 of the first neck 1211 of the first fastening groove 121, when the fastener section 25 is embedded in the first box section 12, the fastener closing section 252 is limited by the first neck 1211 and thus cannot be easily separated from the first fastening groove 121 in the direction Z1 away from the first fastening groove 121, so that the fastener section 25 can be firmly combined with the first fastening groove 121.

Referring to FIG. 9, in some embodiments, the second fastening groove 221 includes a second opening section 2211 and a second closing section 2212. A width W5 of the second opening section 2211 is greater than a width W6 of the second closing section 2212. Therefore, a cross section of the second fastening groove 221 in the depression direction Z2 generally tappers from the second opening section 2211 to the second closing section 2212. Besides, the width W2 of the first closing section 1212 of the first fastening groove 121 is less than the width W6 of the second closing section 2212, so when the first box 1 or a part of the first box 1 leaves the second box 2, the first fastening groove 121 can be separated from the second fastening groove 221 easily.

Referring to FIG. 8 and FIG. 9, in some embodiments, the first fastening groove 121 may further include a first inner side wall 1213 and a first outer side wall 1214. The first outer side wall 1214 is formed by the extension of the first inner side wall 1213 in a direction away from the first body 11, and a part of the first outer side wall 1214 extending along the depression direction Z2 is not parallel to the first inner side wall 1213. The second fastening groove 221 may further include a second inner side wall 2213 and a second outer side wall 2214. The second outer side wall 2214 is formed by the extension of the second inner side wall 2213 in a direction away from the second body 21, and a part of the second outer side wall 2214 extending along the depression direction Z2 is substantially parallel to the second inner side wall 2213. Besides, the first outer side wall 1214 is substantially parallel to the second outer side wall 2214, so when the first box section 12 is stacked on the second box section 22, the first outer side wall 1214 abuts against the second outer side wall 2214, thereby locating the relative position of the first box section 12 stacked on the second box section 22.

Referring to FIG. 8 to FIG. 9, in some embodiments, the first inner side wall 1213 may include a guide section 1213*a*. The guide section 1213*a* is connected to the first neck 1211, and a width W7 of an end of the guide section 1213*a* away from the first closing section 1212 is greater than the width W1 of the first neck 1211. Therefore, in order to ensure the fastener section 25 to be smoothly embedded in the first fastening groove 121, the guide section 1213*a* can guide the fastener section 25 into the first fastening groove 121, then the user applies a force, so that the fastener section 25 passes through the first neck 1211 and then the fastener section 25 is embedded in the first fastening groove 121.

Referring to FIG. 7, in some embodiments, the fastener section 25 may include an anti-opening piece 253 and a fastener opening section 251, and the first box section 12 may further include a first connection surface 1215. The anti-opening piece 253 is formed by the outward extension of the fastener opening section 251. The first connection surface 1215 is connected to the first locking surface 1122 of the first side wall 112. When the fastener section 25 is embedded in the first fastening groove 121, the fastener section 25 and the first fastening groove 121 are substantially located on the same plane and the anti-opening piece 253 abuts against the first connection surface 1215. This can prevent the user from separating the fastener section 25 and the first fastening groove 121 via a gap between the fastener section 25 and the first fastening groove 121 to open the anti-opening container 100 by separating the first box 1 from the second box 2. Referring to FIG. 9 again, in some embodiments, after the first box 1 is separated from the second box 2, the extension section 24 is still connected to the second box 2, and a distance between the extension section 24 and the second outer side wall 2214 gradually decreases from an opening end between the extension section 24 and the second outer side wall 2214 to a connection point between the extension section 24 and the second box 2.

Second Embodiment

It should be noted that in this embodiment, the same parts as those in first embodiment will be denoted by the same element symbols, and the same elements and structures will not be described again.

Figure 10:
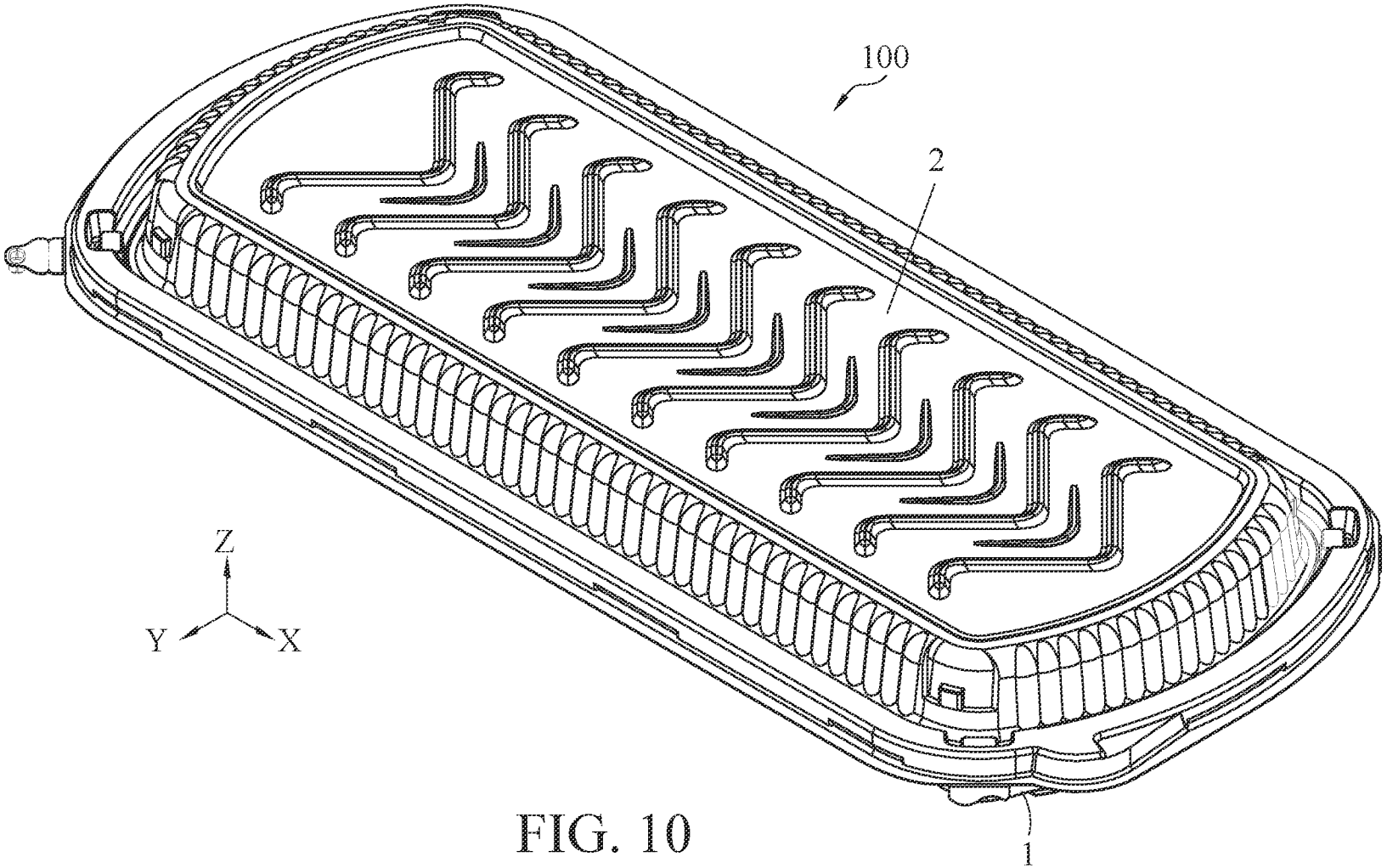
FIG. 10 is a three-dimensional outside view of a second embodiment of the disclosure in a closed state.
Figure 11:
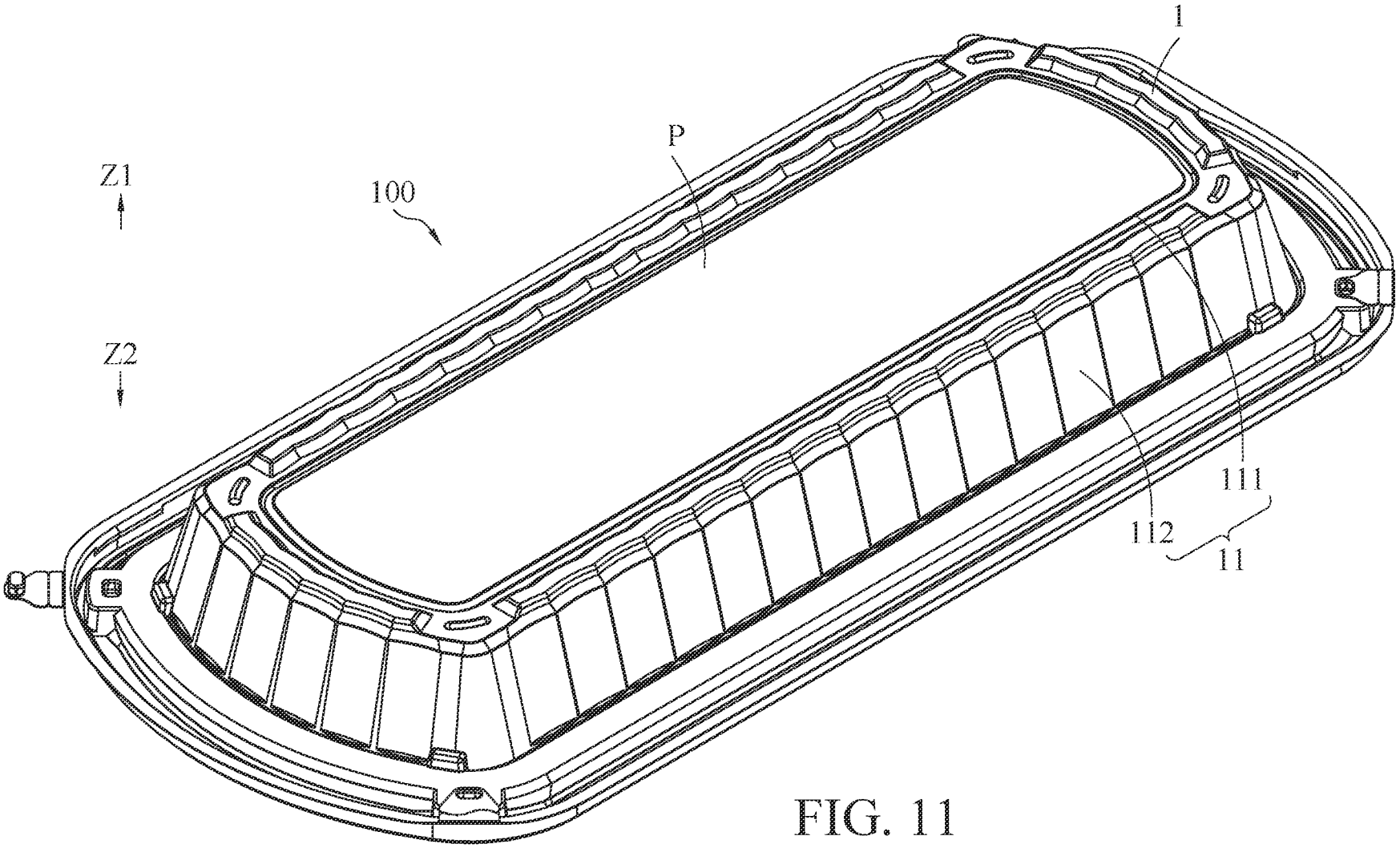
FIG. 11 is a three-dimensional outside view of the second embodiment of the disclosure in a closed state from another viewing angle.

Referring to FIG. 10 to FIG. 11, an anti-opening container 100 of the disclosure mainly includes a first box 1 and a second box 2. In the previous embodiment, the first box 1 is used to cover the second box 2 (as shown in FIG. 1). In this embodiment, the second box 2 is used to cover the first box 1.

Figure 13:
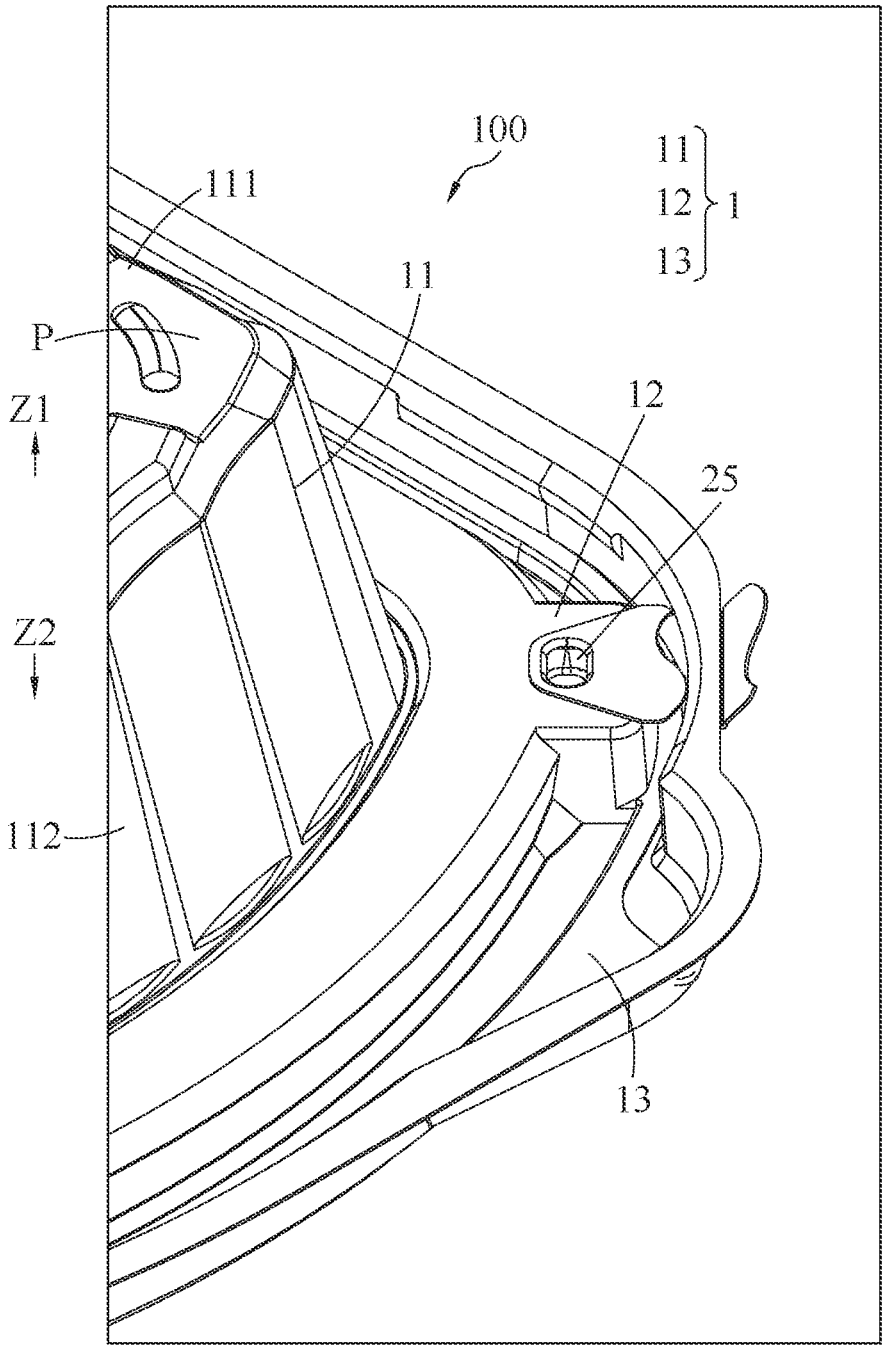
FIG. 13 is a partial enlarged view of the second embodiment of the disclosure in a closed state.

Referring to FIG. 11 to FIG. 13, the first box 1 may mainly consist of a first body 11, a first box section 12 and a first gripping section 13.

The first body 11 may mainly consist of a first base 111 and a first side wall 112. The first side wall 112 forms a receiving space Q (not shown) around the first base 111, and the first base 111 is substantially parallel to a horizontal plane P.

Figure 14:
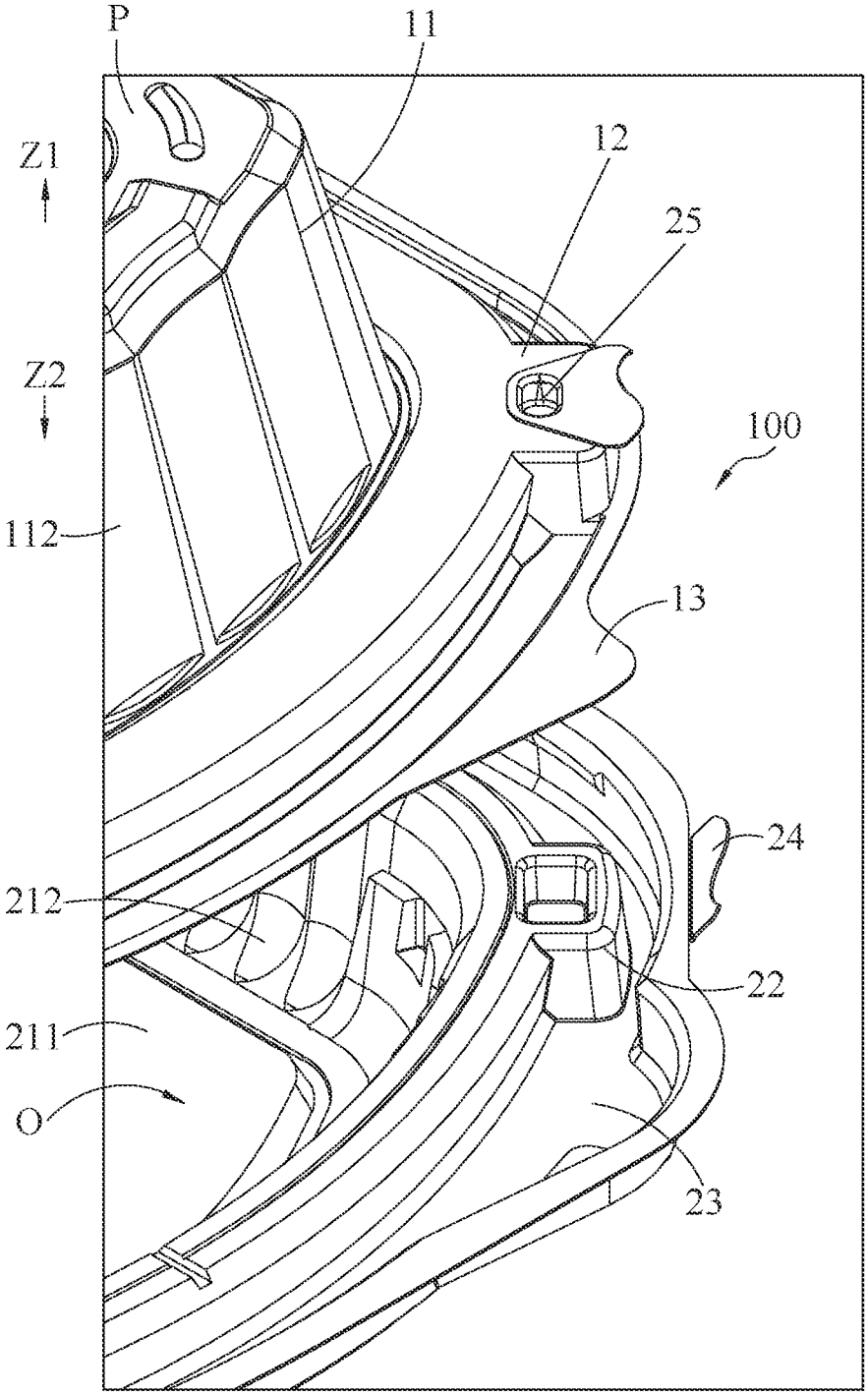
FIG. 14 is a partial enlarged view of the second embodiment of the disclosure in an opened state.
Figure 15:
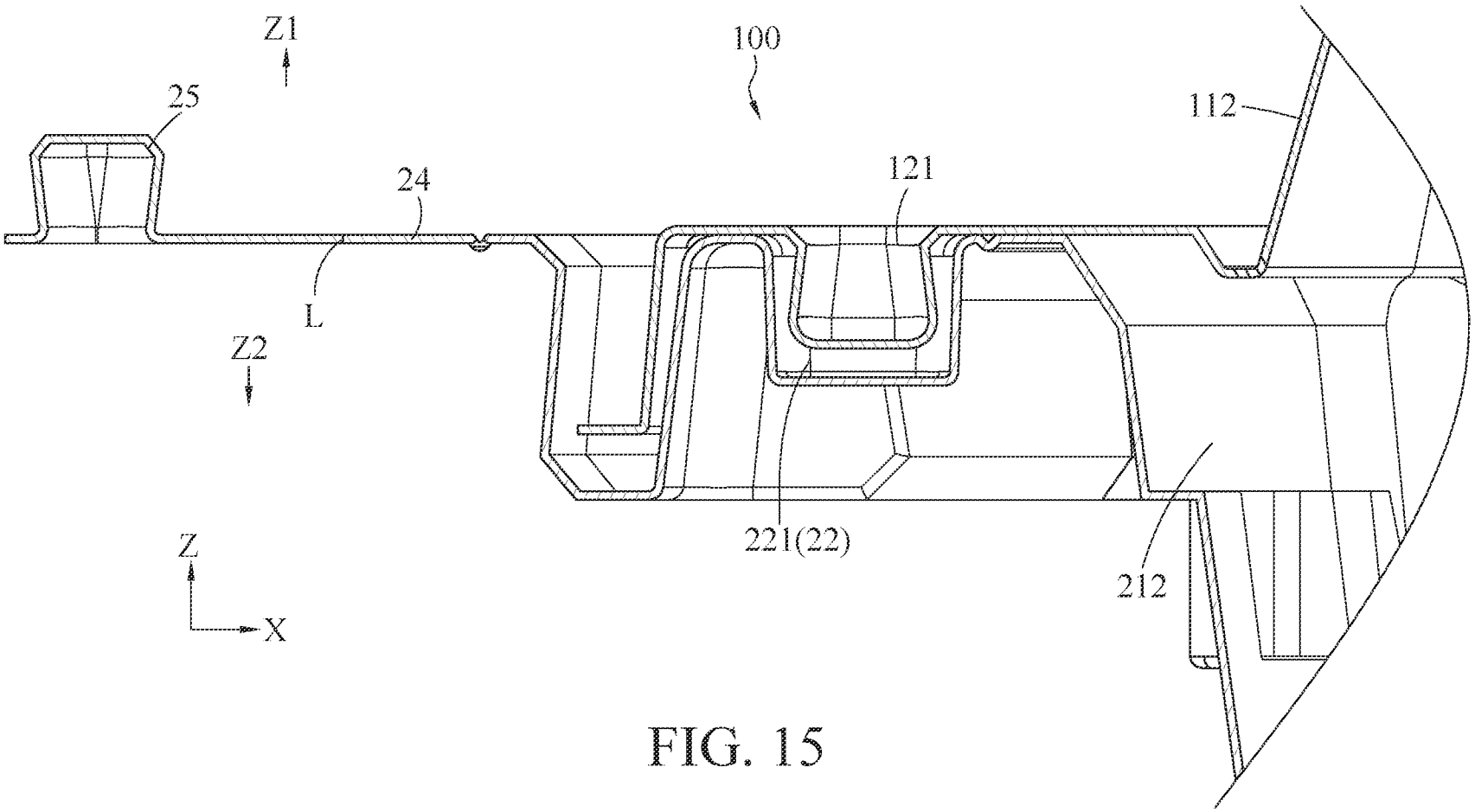
FIG. 15 is a sectional view taken along a line B-B in FIG. 12.

Referring to FIG. 14 and FIG. 15, FIG. 15 is a sectional view of FIG. 12 taken along line B-B. The first box section 12 is formed by the extension of the first side wall 112, and the first box section 12 includes a first fastening groove 121. A depression direction Z2 of the first fastening groove 121 is substantially perpendicular to the horizontal plane P.

The first gripping section 13 is formed by extending in a direction away from the first side wall 112.

The second box 2 may mainly consist of a second body 21, a second box section 22, a second gripping section 23, an extension section 24 and a fastener section 25.

Referring to FIG. 13 and FIG. 14, the second body 21 may mainly consist of a second base 211 and a second side wall 212, and the second side wall 212 forms an accommodating space O around the second base 211.

Figure 16:
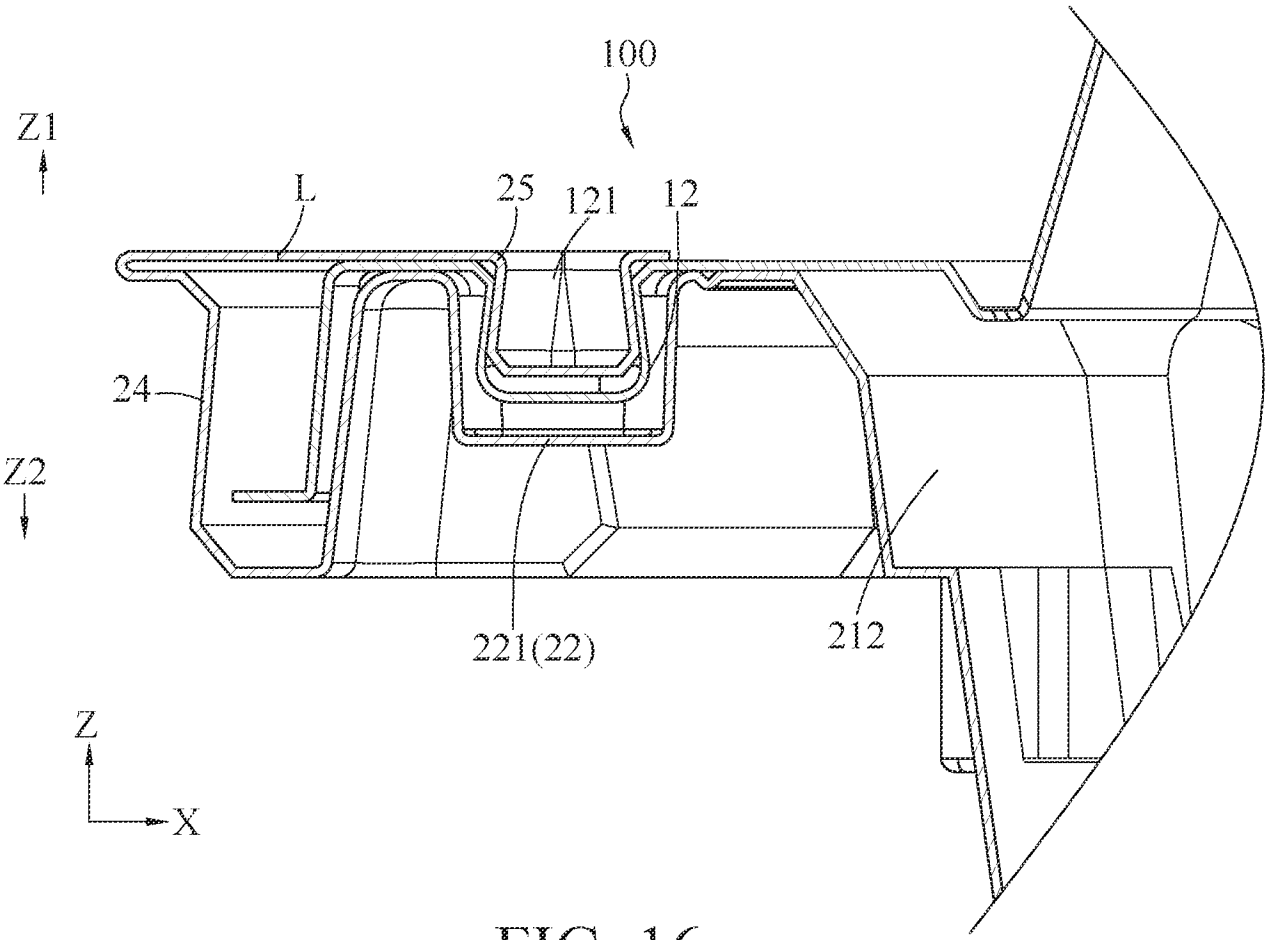
FIG. 16 is a partial sectional view of the second embodiment of the disclosure in a closed state.
Figure 17:
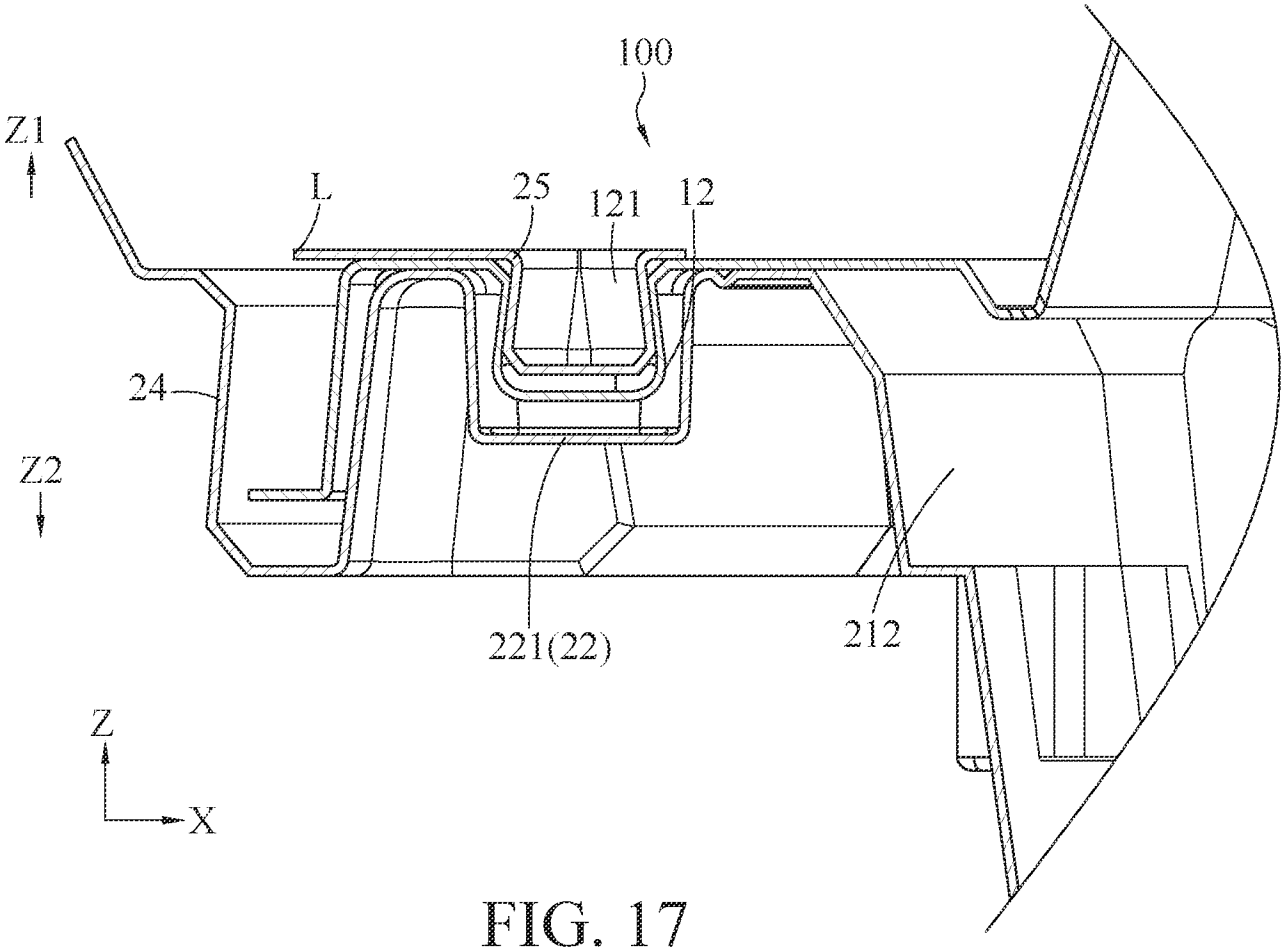
FIG. 17 is a partial sectional view of the second embodiment of the disclosure in a closed state and with the perforated line breaking.

Referring to FIG. 15 to FIG. 17, the second box section 22 is formed by the extension of the second side wall 212, and the second box section 22 includes a second fastening groove 221. A depression direction Z2 of the second fastening groove 221 is substantially perpendicular to the horizontal plane P.

Referring to FIG. 14, the second gripping section 23 is formed by the extension of the second side wall 212.

Referring to FIG. 15 to FIG. 17, the extension section 24 is formed by the extension of the second box section 22, and the fastener section 25 is formed by the extension of the extension section 24 and connected to the extension section 24 via a perforated line L.

Referring to FIG. 15 to FIG. 17, when the first box 1 is combined with the second box 2, the first box section 12 is stacked on the second box section 22 (as shown in FIG. 16), and the fastener section 25 is embedded in the first box section 12 (as shown in FIG. 16).

Referring to FIG. 14, when a user pinches the first gripping section 13 and the second gripping section 23 and displaces the first gripping section 13 and the second gripping section 23 in opposite directions (for example, the first gripping section 13 is displaced toward the direction Z1 above the horizontal plane P, and the second gripping section 23 is displaced toward the direction Z2 below the horizontal plane P), the perforated line L is torn such that the perforated line L breaks (as shown in FIG. 17), and the fastener section 25 and the first box section 12 that are in close fit with each other can be separated from the second box section 22 together. In this way, the user can separate the first box 1 from the second box 2 such that the anti-opening container 100 is opened.

In this embodiment, the first gripping section 13 and the second gripping section 23 are not located on two opposite sides of the first box section 12. As shown in FIG. 14, the first gripping section 13 is stacked on the second gripping section 23.

Besides, in this embodiment, the first fastening groove 121 does not contain the first neck 1211 (as shown in FIG. 8). Referring to FIG. 15 to FIG. 17, the first fastening groove 121 and the fastener section 25 are both hollow cylinders, and cross sections of both the first fastening groove 121 and the fastener section 25 in the depression direction Z2 are generally flared from an open end to a closed end.

Based on the above, the anti-opening container 100 of the disclosure can be opened only after the user pinches the first gripping section 13 and the second gripping section 23 and displace them in opposite directions. When the anti-opening container 100 is opened, the perforated line L breaks, and the extension section 24 spreads out in the direction away from the first box 1, and the fastener section 25 and the first box section 12 that are in close fit with each other are separated from the second box section 22 together. Therefore, the user can easily determine whether the anti-opening container 100 has been opened from appearance, which can prevent the user from buying and eating food whose anti-opening container has been opened, and can reduce the consumption disputes. Besides, the fastener section 25 is embedded in the first box section 12, which can prevent the anti-opening container 100 from being easily opened due to the hit during transportation.

Although the disclosure has been described in considerable detail with reference to certain preferred embodiments thereof, the disclosure is not for limiting the scope of the invention. Persons having ordinary skill in the art may make various modifications and changes without departing from the scope and spirit of the disclosure. Therefore, the scope of the appended claims should not be limited to the description of the preferred embodiments described above.

What is claimed is:

1. An anti-opening container, comprising:

a first box, comprising:

a first body, comprising a first base and a first side wall, the first side wall forming a receiving space around the first base, and the first base being substantially parallel to a horizontal plane;

a first box section, formed by an extension of the first side wall and comprising a first fastening groove, a depression direction of the first fastening groove being substantially perpendicular to the horizontal plane; and a first gripping section, formed by the extension of the first side wall; and a second box, comprising:

a second body, comprising a second base and a second side wall, the first base and the second base being arranged opposite to each other, and the second side wall forming an accommodating space around the second base;

a second box section, formed by an extension of the second side wall and comprising a second fastening groove, a depression direction of the second fastening groove being substantially perpendicular to the horizontal plane;

a second gripping section, formed by the extension of the second side wall;

an extension section, formed by the extension of the second box section; and a fastener section, formed by the extension of the extension section and connected to the extension section via a perforated line;

wherein when the first box is combined with the second box, the first box section is stacked on the second box section, and the fastener section is embedded in the first box section; and when the first gripping section and the second gripping section are displaced in opposite directions, the perforated line breaks, and the first box section and the fastener section are separated from the second box section together to separate the first box and the second box;

wherein the first fastening groove comprises a first neck and a first closing section, the fastener section comprises a fastener opening section and a fastener closing section, a width of the first neck is less than a width of the first closing section, and a width of the fastener opening section is less than a width of the fastener closing section;

wherein the first fastening groove further comprises a first inner side wall and a first outer side wall, the second fastening groove further comprises a second inner side wall and a second outer side wall, and the first outer side wall is formed by extending from the first inner side wall in a direction away from the first body, the second outer side wall is formed by extending from the second inner side wall in a direction away from the second body, and when the first box section is stacked on the second box section, the first outer side wall abuts against the second outer side wall;

wherein the first and second boxes are so configured that, after the first box is separated from the second box, the extension section is still connected to the second box, and a distance between the extension section and the second outer side wall gradually decreases from an opening end between the extension section and the second outer side wall to a connection point between the extension section and the second box; and wherein the first inner side wall further comprises a guide section, the guide section being connected to the first neck, and a width of an end of the guide section away from the first closing section being greater than the width of the first neck.

2. The anti-opening container according to claim 1, wherein the extension section further comprises a bending member connected to the second gripping section and connected to the fastener section via the perforated line, and when the first box is combined with the second box, the bending member bends such that the fastener section is embedded in the second box section.

3. The anti-opening container according to claim 1, wherein the first fastening groove comprises a first side and a second side opposite to each other, the first gripping section being located at the first side, and the second gripping section being located at the second side.

4. The anti-opening container according to claim 1, wherein the first side wall comprises a first side wall body and a first locking surface, the second side wall comprises a second side wall body and a second locking surface, the first locking surface is located at an outer side of a periphery of the first side wall body, the second locking surface is located at an outer side of a periphery of the second side wall body, and the first locking surface is locked with the second locking surface so as to locate relative positions of the first box and the second box.

5. The anti-opening container according to claim 1, wherein the width of the fastener closing section is greater than the width of the first neck.

6. The anti-opening container according to claim 1, wherein the second fastening groove comprises a second opening section and a second closing section, a width of the second opening section is greater than a width of the second closing section, and the width of the first closing section is less than the width of the second closing section.

7. The anti-opening container according to claim 4, wherein the fastener section comprises an anti-opening piece and a fastener opening section, the first box section further comprises a first connection surface, the anti-opening piece is formed by the outward extension of the fastener opening section, the first connection surface is connected to the first locking surface, and the anti-opening piece is substantially parallel to the connection surface and abuts against the connection surface.

* * * * *